US009616653B2

(12) United States Patent
Liu

(10) Patent No.: US 9,616,653 B2
(45) Date of Patent: Apr. 11, 2017

(54) SYSTEMS AND METHODS FOR INK-BASED DIGITAL PRINTING USING DAMPENING FLUID IMAGING MEMBER AND IMAGE TRANSFER MEMBER

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 13/599,004

(22) Filed: Aug. 30, 2012

(65) Prior Publication Data

US 2014/0060351 A1 Mar. 6, 2014

(51) Int. Cl.

| | |
|---|---|
| ***B41L 25/16*** | (2006.01) |
| ***B41C 1/10*** | (2006.01) |
| ***B41J 2/005*** | (2006.01) |
| ***B41M 1/06*** | (2006.01) |

(52) U.S. Cl.

CPC ..... *B41C 1/10* (2013.01); *B41J 2/0057* (2013.01); *B41M 1/06* (2013.01); *B41C 2210/02* (2013.01); *B41C 2210/08* (2013.01)

(58) Field of Classification Search

CPC ..... B41F 3/32; B41F 7/30

USPC ..... 101/147, 483, 450.1, 451, 132.5, 366, 101/364, 423

See application file for complete search history.

(56) References Cited

U.S. PATENT DOCUMENTS

| | | | | |
|---|---|---|---|---|
| 3,741,118 | A * | 6/1973 | Carley | 101/451 |
| 3,894,873 | A * | 7/1975 | Kobayashi | B41M 1/08 430/281.1 |
| 5,046,417 | A * | 9/1991 | Paulson | B41F 7/26 101/148 |
| 6,006,059 | A * | 12/1999 | Till et al. | 399/249 |
| 6,354,202 | B1 * | 3/2002 | Heiler | B41F 7/40 101/148 |
| 7,998,275 | B2 * | 8/2011 | Frey et al. | 134/6 |
| 2007/0199462 | A1 * | 8/2007 | Cyman et al. | 101/211 |
| 2011/0065048 | A1 * | 3/2011 | Kearney | B41C 1/1025 430/286.1 |
| 2012/0103212 | A1 | 5/2012 | Stowe et al. | |
| 2012/0103221 | A1 | 5/2012 | Stowe et al. | |
| 2013/0104756 | A1 | 5/2013 | Stowe et al. | |
| 2014/0063161 | A1 | 3/2014 | Liu | |

* cited by examiner

*Primary Examiner* — Matthew G Marini
*Assistant Examiner* — Quang X Nguyen
(74) *Attorney, Agent, or Firm* — Prass LLP

(57) ABSTRACT

An ink-based digital printing system for variable data lithographic printing includes an imaging member having a surface configured to absorb dampening fluid. A dampening fluid patterning system jets dampening fluid onto the imaging member surface according to image data to form a dampening fluid pattern. The system includes a transfer member that receives the jetted dampening fluid pattern from the imaging member at a dampening fluid loading nip for subsequent inking of the dampening fluid pattern to form an ink pattern. The ink pattern is transferred to a substrate from the transfer member at an ink pattern transfer nip.

13 Claims, 4 Drawing Sheets

INKJET IMAGING

DAMPENING FLUID IMAGE TRANSFER

DAMPENING FLUID REMOVAL
WITH VACUUM ASSISTED BLOTTER

INKJET IMAGING

DAMPENING FLUID IMAGE TRANSFER

DAMPENING FLUID REMOVAL WITH HEAT AND AIR FLOW

SYSTEMS AND METHODS FOR INK-BASED DIGITAL PRINTING USING DAMPENING FLUID IMAGING MEMBER AND IMAGE TRANSFER MEMBER

RELATED APPLICATIONS

This application is related to co-pending U.S. application Ser. No. 13/599,380, titled SYSTEMS AND METHODS FOR INK-BASED DIGITAL PRINTING USING IMAGING MEMBER AND IMAGE TRANSFER MEMBER, the disclosure of which is incorporated by reference herein in its entirety.

FIELD OF DISCLOSURE

The disclosure relates to ink-based digital printing. In particular, the disclosure relates to methods and systems for ink-based digital printing with an printing system having a dampening fluid imaging member and an image transfer member that receives a dampening fluid image from the imaging member.

BACKGROUND

Related art ink-based digital printing systems, or variable data lithography systems configured for digital lithographic printing, include an imaging system for laser patterning a layer of dampening fluid applied to an imaging member. The imaging system includes a high power laser for emitting light energy. The imaging member must include a costly reimageable surface layer, such as a plate or blanket that is capable of absorbing light energy, among other demands required for image production. While high print speeds and reduced system and operating costs are generally desirable, print speeds achieved using related art ink-based digital printing systems are limited by the laser imaging process.

SUMMARY

Systems and methods are provided that enable high resolution dampening fluid patterning for ink-based digital printing. Systems and methods may include a device, such as an inkjet printhead, for ejecting or depositing dampening fluid directly onto an imaging member to form a pattern or image according to variable image data. Systems and methods may include a transfer member configured to define a dampening fluid pattern or image loading nip at which the dampening fluid pattern or image is transferred to the transfer member for subsequent inking.

In an embodiment of systems, ink-based digital printing systems may include an imaging member; and a dampening fluid patterning system 203 configured to deposit dampening fluid onto a surface of the imaging member according to image data. The imaging member may be configured to absorb an amount of dampening fluid. The dampening fluid patterning system 203 may include an inkjet apparatus configured to jet the dampening fluid onto the surface of the imaging member. The deposited dampening fluid may be deposited to in pattern to form a high resolution image on the surface of the imaging member.

In an embodiment, systems may include a transfer member, the transfer member being configured to receive a dampening fluid pattern from a surface of the imaging member, the transfer member and the imaging member being arranged to define a dampening fluid image loading nip for contact transfer. The imaging member may include a porous surface. The porous surface may have a thickness of 10 micrometers to 100 micrometers.

In an embodiment, systems may include an imaging member cleaning system, the imaging member cleaning system including vacuum assisted blotter. Systems may include the porous surface being conformable. Systems may include a non-porous surface configured to absorb dampening fluid causing swelling of the surface. The non-porous surface may have a thickness lying in a range of 25 micrometers to 100 micrometers. The dampening fluid may include silicone fluid, and system may include the non-porous surface further comprising silicone. In an embodiment, systems may include an imaging member cleaning system, the cleaning system being configured for heating the surface of the imaging member to evaporate absorbed dampening fluid.

In an embodiment, methods for ink-based digital printing may include jetting a dampening fluid pattern onto a surface of an imaging member; and transferring the dampening fluid pattern to a transfer member at a dampening fluid pattern loading nip defined by the transfer member and the imaging member. Methods may include applying ink to a surface of the transfer member having the dampening fluid pattern to produce an ink pattern. Methods may include conditioning the ink pattern to increase a viscosity of the ink before transfer of the ink pattern to a substrate. Methods may include transferring the ink pattern to a substrate at an ink pattern loading nip defined by the transfer member and a substrate transport system.

In an embodiment, methods may include applying heat to the surface of the imaging member to evaporate dampening fluid contained by the imaging member surface dampening fluid. Methods may include removing dampening fluid from the surface of the imaging member after the transferring the dampening fluid pattern, the removing comprising blotting and vacuuming the surface of the imaging member. Methods may include flooding a surface of the imaging member with dampening fluid before the removing the dampening fluid. In an embodiment, methods may include removing ink remaining on the surface of the transfer member after the transferring the ink pattern.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
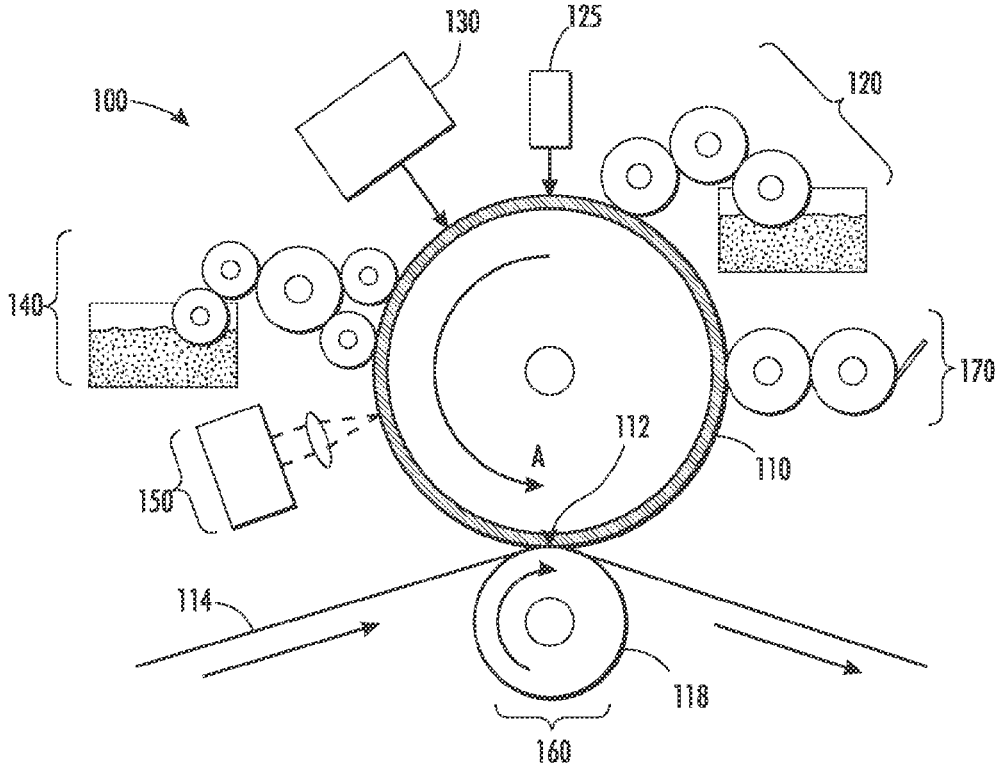
FIG. 1 RELATED ART
FIG. 1 shows a diagrammatical view of a related art digital architecture lithographic printing system for ink-based digital printing.

Exemplary embodiments are intended to cover all alternatives, modifications, and equivalents as may be included within the spirit and scope of the apparatus and systems as described herein.

Reference is made to the drawings to accommodate understanding of systems and methods for ink-based digital printing using a dampening fluid imaging member and a transfer member that are arranged to define a dampening fluid pattern or image loading nip. In the drawings, like reference numerals are used throughout to designate similar or identical elements. The drawings depict various embodiments of illustrative systems and methods for ink-based digital printing using a dampening fluid imaging member and a transfer member.

Related art ink-based digital printing systems that use high power lasers for laser patterning dampening fluid on an imaging plate can be costly and have limited print speeds. U.S. patent application Ser. No. 13/095,714 (the 714 application), which is commonly assigned and the disclosure of which is incorporated by reference herein in its entirety, proposes systems and methods for providing variable data lithographic and offset lithographic printing or image receiving medium marking. The systems and methods disclosed in the 714 application are directed to improvements on various aspects of previously-attempted variable data imaging lithographic marking concepts based on variable patterning of dampening fluids to achieve effective truly variable digital data lithographic printing.

According to the 714 application, a reimageable surface is provided on an imaging member, which may be a drum, plate, belt or the like. The reimageable surface may be composed of, for example, a class of materials commonly referred to as silicones, including polydimethylsiloxane (PDMS) among others. The reimageable surface may be formed of a relatively thin layer over a mounting layer, a thickness of the relatively thin layer being selected to balance printing or marking performance, durability and manufacturability.

The 714 application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a plate or a belt, or another now known or later developed configuration. The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 application also explains the wide latitude of marking (printing) materials that may be used, including marking materials with pigment densities greater than 10% by weight. As does the 714 application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 application depicts and describes details of the imaging member 110 including the imaging member 110 being comprised of a reimageable surface layer formed over a structural mounting layer that may be, for example, a cylindrical core, or one or more structural layers over a cylindrical core. The exemplary system 100 includes a dampening fluid subsystem 120 generally comprising a series of rollers, which may be considered as dampening rollers or a dampening unit, for uniformly wetting the reimageable surface of the imaging member 110 with dampening fluid. A purpose of the dampening fluid subsystem 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. Small amounts of certain surfactants may be added to the fountain solution as well. Alternatively, other suitable dampening fluids may be used to enhance the performance of ink based digital lithography systems. Suitable dampening fluids are disclosed, by way of example, in co-pending U.S. patent application Ser. No. 13/284,114, titled DAMPENING FLUID FOR DIGITAL LITHOGRAPHIC PRINTING, the disclosure of which is incorporated herein by reference in its entirety.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid subsystem 120.

Once a precise and uniform amount of dampening fluid is provided by the dampening fluid subsystem 120 on the reimageable surface of the imaging member 110, and optical patterning subsystem 130 may be used to selectively form a latent image in the uniform dampening fluid layer by imagewise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to FIG. 5 in the 714 application. Briefly, the application of optical patterning energy from the optical patterning subsystem 130 results in selective evaporation of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing in the reimageable layer of the imaging member 110 may be modified by a number of mechanisms. One such mechanism may involve the use of a rheology (complex viscoelastic modulus) control subsystem 150. The rheology control system 150 may form a partial crosslinking core of the ink on the reimageable surface to, for example, increase ink cohesive strength relative to the reimageable surface layer. Curing mechanisms may include optical or photo curing, heat curing, drying, or various forms of chemical curing. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. With the adhesion of the ink having been modified by the rheology control system 150, modified adhesion of the ink causes the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife 175 may be employed to remove residual dampening fluid. It is anticipated, however, that some amount of ink residue may remain. Removal of such remaining ink residue may be accomplished through use of some form of cleaning subsystem 170. The 714 application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid subsystem 120 by which a fresh layer of dampening fluid is supplied to the reimageable surface of the imaging member 110, and the process is repeated.

According to the above proposed structure, variable data digital lithography has attracted attention in producing truly variable digital images in a lithographic image forming system. The above-described architecture combines the functions of the imaging plate and potentially a transfer blanket into a single imaging member 110 that must have a light absorptive surface.

Related art ink-based digital printing systems having a high power imaging laser are costly. The high power laser imager is costly, and the imaging member must include a costly reimageable plate or surface layer that is capable of absorbing light energy and is subject to numerous other design constraints. Print speeds achieved using the laser imaging process can be slow. It is desirable to achieve higher print speeds and reduce system and operating costs by jetting dampening fluid onto an imaging member surface in a pattern according to image data, foregoing the need for laser patterning, and the associated costs of a laser imaging or patterning device. It has been found, however, that implementing a ink jet system for jetting dampening fluid onto an imaging member results in excessive dampening fluid jetted onto the imaging plate, and excessive dampening fluid at the inking system, making it difficult to achieve a high resolution image.

For example, it has been found that a resolution achieved by jetting dampening fluid onto a typical reimageable imaging plate such as the imaging plate shown in FIG. 1 may be unsatisfactory. In particular, a size of an ink jet dampening fluid droplet deposited on a surface of a typical imaging plate is undesirably large after spreading to a desired thickness of about 1 micrometer. To achieve higher image fidelity, there is a desire to use an even thinner layer of dampening fluid, in the range of 0.1 to 0.5 micrometers. For example, a one picoliter drop will spread to a spot size of 36 micrometers in diameter at one micrometer of thickness. A one picoliter drop will spread to a spot size of 51 micrometers at 0.5 micrometers of thickness. A 10 picoliter drop may spread to a spot size of 113 micrometers at one micrometer thickness, and a spot size of 160 micrometers at 0.5 micrometer thickness. Further, the dampening fluid droplet may not be able to spread to a desired thickness, e.g., about one micrometer or thinner, within a desired timeframe. Consequently, a thick layer of dampening fluid may result and cause, for example, an inker to force an unstable hydrodynamic flow of dampening fluid at an inking nip. This may result in various image defects and excessive dampening fluid pickup by the inker.

Systems are desired that obviate the need for a laser patterning system and reimageable light-absorbing imaging plate. De Joseph et al. discloses a system that uses a print head to deposit a gating substance onto a substrate or intermediate member. De Joseph et al., APPARATUS AND METHODS FOR CONTROLLING APPLICATION OF A SUBSTANCE TO A SUBSTRATE (WO/2009/025821). In the De Joseph system, a substance such as ink is then applied to the same substrate or intermediate member to adhere to a surface of the member according to the gating substance. Due to the variations in properties of various substrates, the gating substance or agent image may suffer from inconsistent image quality which will affect the ink image quality. When an intermediate member is used, the excessive amount of gating agent on the intermediate will also cause image quality problem and ink-gating agent cross-contamination problem.

Systems and methods of embodiments divide imaging plate functionality between two distinct physical members: an imaging member that receives dampening fluid, and a transfer member that receives marking material such as ink from an adjacent inking system. The imaging member and the transfer member may be rolls or cylinders. The imaging member may be configured to absorb dampening fluid on a surface thereof, where the dampening fluid is jetted to form a high resolution image. The imaging member may be configured, for example, to spread most of the dampening fluid uniformly to form a high quality dampening fluid image.

The imaging member may then be brought into contact with a transfer member that receives the dampening fluid image. The imaging member and the transfer member may define a dampening fluid image (or pattern) loading nip for contact transfer of the dampening fluid pattern or image from the imaging member to the transfer member. At the loading nip, a region of the surface of the imaging member soaked with dampening fluid may be damp, and upon contacting the transfer member, will release a small amount (less than 50%) of dampening fluid for transfer to the surface of the transfer member. After the dampening fluid image is transferred to a surface of the transfer member, ink is deposited onto the transfer member, which selectively adheres to the surface according to the dampening fluid image or pattern.

Figure 2:
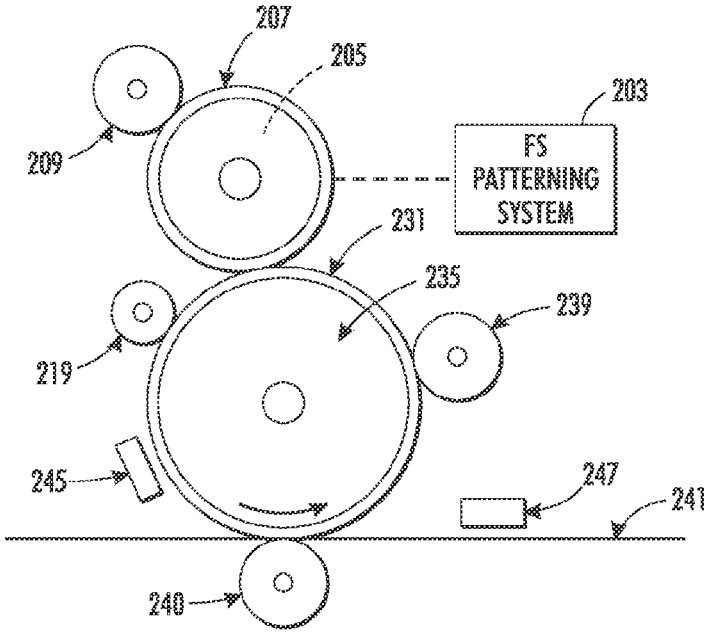
FIG. 2 shows a ink-based digital printing system in accordance with an embodiment.

FIG. 2 shows an ink-based digital printing system in accordance with an embodiment. In particular, FIG. 2 shows an imaging member 205. The amount of the dampening fluid that gets transferred onto the transfer member will be reduced by about 50% due to the splitting at the dampening fluid loading nip. To further reduce the amount of dampening fluid transfer to the transfer member, the imaging member 205 includes a dampening fluid-absorbing surface 207. Preferably, the imaging member surface 207 is configured to absorb dampening fluid droplets quickly without excessive lateral spreading. High resolution dampening fluid images may be obtained on the surface 207 wherein the surface is damp, but not excessively wet. In an embodiment, the imaging member may be a porous material. The imaging member may be formed of foam, sponge, or materials that swell after absorbing dampening fluid. In another embodiment, the absorption of dampening fluid may be optimized to enhance dampening fluid absorption in a direction of the depth of the imaging member, and minimizing the dampening fluid spreading in a lateral direction. This may be achieved by creating pores or channels that are oriented preferentially in a direction that is normal to the surface 207.

In an embodiment, a multilayered structure may be constructed for the imaging member. Porosity may be varied across the thickness of the imaging member with micropores formed on the top surface of the imaging member, and courser structures beneath it. For example, a microporous coating may be applied to a relatively courser foam. A top surface should have characteristics similar to that of coated inkjet paper or inkjet substrates.

The capacity of the absorption and the rate of absorption should be optimized such that a surface of the imaging member is damp, but not too dry and not too wet when the surfacing of the imaging member contacts the transfer member. This may be partially controlled by a variable drying step between the dampening fluid jetting and the transfer of the dampening fluid image from the imaging member to the transfer member.

Systems may include a dampening fluid cleaning system 209. The dampening fluid cleaning system 209 may include a vacuum assisted blotter as described in U.S. Pat. No. 6,006,059, titled FUNCTION-SEPARATED VACUUM-ASSISTED BLOTTER FOR LIQUID DEVELOPMENT IMAGE CONDITIONING, the disclosure of which is incorporated by reference herein in its entirety. Such a cleaning system may be used for systems having an imaging member with a surface 207 that is conformable and microporous, for example. Alternatively, cleaning system 209 may include a heating system for evaporating dampening fluid absorbed by an imaging member surface.

Systems may include an inker 219 for applying ink to a surface 231 of a transfer member 235. Systems may include a transfer member cleaning system 239 for removing ink from the transfer member after transfer of an ink image to media.

The transfer member 235 may be configured to form a dampening fluid pattern or image loading nip with the imaging member 205 such that a dampening fluid image deposited on a region of the imaging member surface 207 is transferred to the transfer member surface 231 under pressure at the nip. In particular, a light pressure may be applied between the transfer member surface 231 and the imaging member surface 207. In an area where dampening fluid has been applied to be damp, and a small amount of dampening fluid, e.g., about one micrometer or less, will be transferred to the transfer member surface 231. The amount of dampening fluid transferred may be adjusted by contact pressure adjustments.

After the dampening fluid image is transferred to the transfer member 235, ink from the inker 219 is applied to a transfer member surface 231 to form an ink pattern or image. The ink pattern or image may be a negative of or may correspond to the dampening fluid pattern. The ink image may be transferred to media at an ink image transfer nip defined by a substrate transport roll 240 and the transfer member 235. The substrate transport roll 240 may urge a paper transport 241, for example, against the transfer member surface 231 to facilitate contact transfer of an ink image from the transfer member 235 to media carried by the paper transport 241.

Systems may include rheological conditioning system 245 for increasing a viscosity of ink of an ink image before transfer of the ink image at the ink image transfer nip. Systems may include a curing system 247 for curing an ink image on media after transfer of the ink image from the transfer member 235 to media carried by the paper transport 241, for example. The pre-cure system 245 may be positioned before a transfer member 235, with respect to a media process direction. The curing system 247 may be positioned after a transfer member 235, with respect to a media process direction. After transfer of the ink image from the transfer member 235 to the media, residual ink may be removed by a transfer member cleaning system 239.

After transfer of the dampening fluid pattern from the imaging member surface 207, the imaging member 205 may be cleaned in preparation for a new cycle. Various methods for cleaning the imaging member surface 207 may be used, including high pressure, squeegee-type devices, heat, convection, blotting and vacuum systems, etc. A combination of these methods may be implemented, and may be preferred. The high pressure cleaning method may employ a pressure that is significantly higher than a pressured used at the dampening fluid pattern loading nip defined by the transfer member 235 and its surface 231, and the imaging member 205 and its surface 207.

In an embodiment of systems and methods, the imaging member may be cleaned by first flooding the imaging member with dampening fluid to erase a dampening fluid imaging pattern left after dampening fluid pattern transfer. Subsequently, high pressure may be used in combination with other means to remove a majority of the dampening fluid from the bulk of the imaging member 205. The imaging member may be still be somewhat damp. Convection or airflow with optional heat may be used to dry the surface 207 of the imaging member 205.

Figure 3:
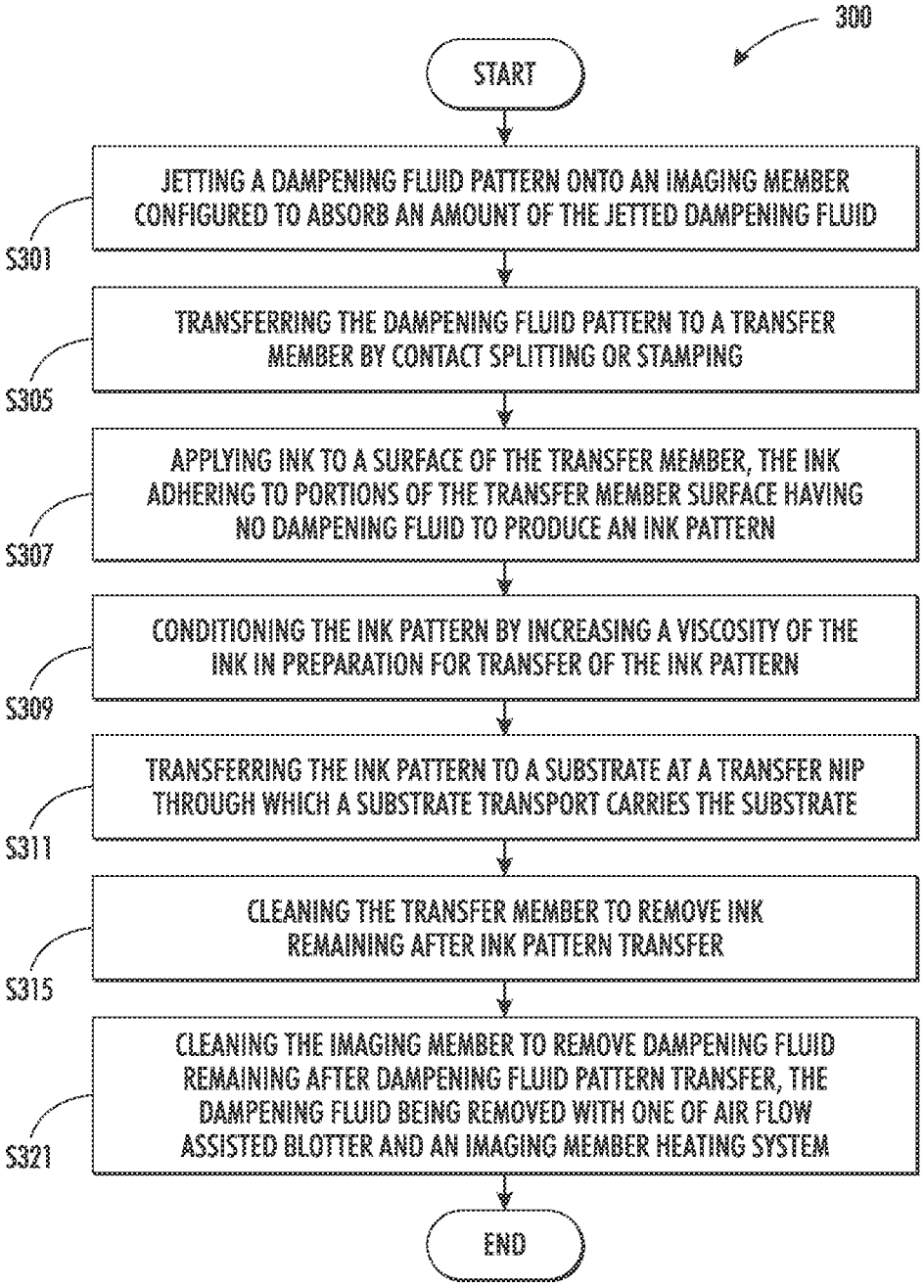
FIG. 3 shows an ink-based digital printing method in accordance with an embodiment.

FIG. 3 shows methods for ink-based digital printing using a variable data lithography printing system configured for digital lithographic printing in accordance with an embodiment. In particular, FIG. 3 shows an ink-based digital printing process 300. Methods may include jetting dampening fluid onto an imaging member surface according to image data, so that patterned dampening fluid image is formed at S301. The imaging member is configured to absorb an amount of dampening fluid.

Methods may include transferring the dampening fluid pattern or image at S305 to a transfer member. In particular, the dampening fluid image may be transferred under pressure at a dampening fluid pattern (or image) loading nip formed by the imaging member and the transfer member. The dampening fluid image may be split, stamped, or contact transferred to the transfer member from the imaging member at the loading nip at S305.

Methods may include inking a surface of the transfer member at S307. The ink may adhere to portions of the transfer member surface having no dampening fluid, to produce an ink pattern or image. Methods may include rheological conditioning of the ink image at S309. The ink image may be conditioned to increase the viscosity of the ink in preparation for effective transfer of the ink image at a pressure nip formed by the transfer member and a substrate transport roll. In particular, methods may include pre-curing the ink image before transfer of the ink image to a substrate such as paper or packaging.

Methods may include transferring the ink image from the transfer member to a substrate at S311. In particular, the ink may be transferred to a substrate such as a paper carried by a substrate transport path. The substrate transport path may be configured to carry a substrate through the transfer nip formed by the transfer member and the substrate transport roll. Methods may include cleaning the transfer member at S315 to remove ink remaining after ink pattern or image transfer from the transfer roll to the substrate. Methods may include cleaning the imaging member at S321. In particular, the imaging member may be cleaned by a cleaning system configured to remove dampening fluid remaining on the imaging member surface after transfer of a dampening fluid image from the imaging member to the transfer member at S305.

Figure 4A:
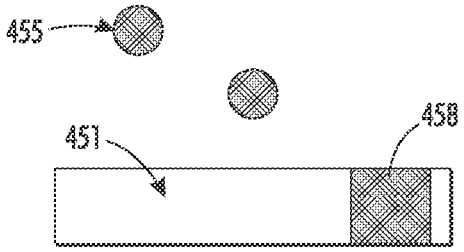
FIGS. 4A-4C show a side diagrammatical cross-sectional view of an imaging member during steps of an ink-based digital printing process in accordance with an embodiment.
Figure 4B:
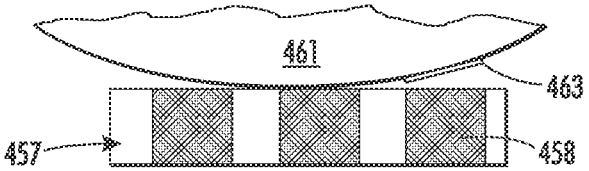
Figure 4C:
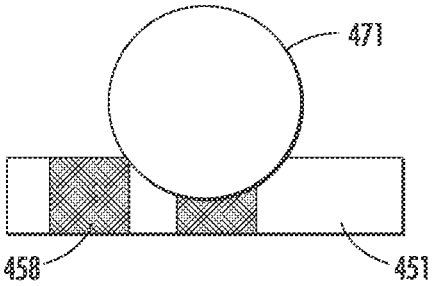

FIGS. 4A through 4C show a side diagrammatical cross-sectional view of an imaging member during steps of an ink-based digital printing process in accordance with an embodiment. In the embodiment shown in FIGS. 4A-4C, the imaging member is made of a porous material with micropores having a size of about one micrometer or less. The imaging member may have a total thickness of 10 micrometers to 100 micrometers such that its fluid capacity is around 5 micrometers to 50 micrometers across a thickness of the imaging member. Preferably, the imaging member is formed with conformable porous material such as microfoam. Accordingly, dampening fluid absorbed by the imaging member may be squeezed out for cleaning. A cleaning system comprising a vacuum assisted blotter is useful for such a configuration.

FIG. 4A shows an imaging member 451 formed of a porous material. The porous material defines open pockets of space occupied by air before absorption of dampening fluid. FIG. 4A shows the imaging member 451 during an ink jet dampening fluid jetting step of an ink-based digital printing process. Dampening fluid 455 is jetted onto a surface of the imaging member 451. FIG. 4A shows previously jetted dampening fluid 458 absorbed by the imaging member 451, which is microporous.

FIG. 4B shows the imaging member 451 having absorbed dampening fluid 458. The region of the imaging member 451 having the absorbed dampening fluid 458 is located at a dampening fluid image loading nip defined by the imaging member 451 and a transfer member 461. FIG. 4B shows transferred dampening fluid 463 positioned on the transfer member 461 after contact transfer at the loading nip.

FIG. 4C shows the imaging member 451 after dampening fluid transfer at the loading nip. The imaging member 451 includes residual absorbed dampening fluid 458 before a vacuum assisted blotter cleaning system 471, with respect to a process direction. The vacuum assisted blotter cleaning system may be used to remove the absorbed dampening fluid 458 from the bulk of the imaging member 451.

Figure 5A:
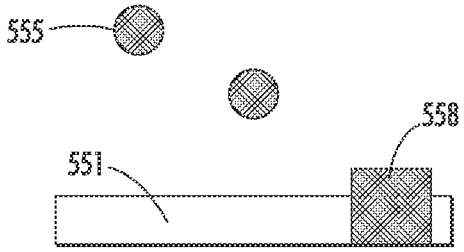
FIGS. 5A-5C show a side diagrammatical cross-sectional view of an imaging member during steps of an ink-based digital printing process in accordance with an embodiment.
Figure 5B:
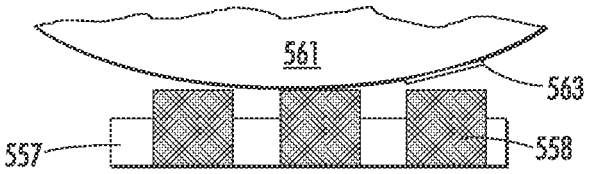
Figure 5C:
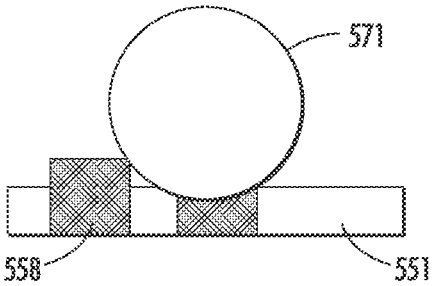

FIGS. 5A-5C show a side diagrammatical cross-sectional view of a non-porous absorbing imaging member during steps of an ink-based digital printing process in accordance with an embodiment. The imaging member is formed of non-porous material into which dampening fluid soaks, causing a corresponding surface of the imaging member to swell. This can be made possible when the imaging member surface material and the dampening fluid are very compatible (similar in chemical nature). For example, a silicone type imaging member surface will swell with the absorption of silicone oil as the dampening fluid. FIG. 5A shows an imaging member 551. The imaging member 551 is formed of, for example, silicone. FIG. 5A shows the imaging member 551 during a step of jetting dampening fluid 555 onto the imaging member 551. FIG. 5A shows the jetted dampening fluid 558 absorbed by the imaging member 551, which has caused a corresponding surface of the imaging member 551 to swell. The dampening fluid used in the process shown in FIG. 5A is comprised of silicone oil such as D4. When a drop of silicone dampening fluid is jetted onto a surface of the silicone imaging member, a drop is absorbed quickly, leaving a raised spot on the silicone imaging member surface. Preferably, a thickness of the silicone imaging member optimizes both absorption of the silicon dampening fluid and removal of the dampening fluid after transfer of a dampening fluid image at a transfer nip. A preferred thickness of the imaging member 551 is 25 micrometers to 200 micrometers. Dampening fluid absorbed by the imaging member may be evaporated by an external heat roll. The vapor may be re-condensed and recycled.

FIG. 5B shows the imaging member 551 having absorbed dampening fluid 558 through swelling. FIG. 5B shows a portion of the imaging member 551 having the absorbed dampening fluid 558 at a dampening fluid pattern or image loading nip defined by the imaging member 551 and the transfer member 561. FIG. 5B shows dampening fluid 563 transferred from the imaging member 551 at the transfer nip.

FIG. 5B shows the imaging member 551 after transfer of the dampening fluid at the transfer nip shown in FIG. 5B. FIG. 5C shows absorbed dampening fluid 558 located at a portion of the imaging member 551 positioned before a dampening fluid cleaning system 571, with respect to a process direction of the imaging member 551. The cleaning system 571 may include a heating system for removing the absorbed dampening fluid 558 from the bulk of the imaging member 551 by vaporizing the absorbed dampening fluid. FIG. 5C shows that the portion of the imaging member 551 that follows the cleaning system 571, with respect to a process direction of the imaging member 551, is substantially free of dampening fluid.

Systems and methods of embodiments for ink-based digital printing accommodate high resolution jetting of dampening fluid on an imaging member without excessive amounts of dampening fluid approaching the inker associated with a transfer member. Systems and methods obviate costs and print speed limitations associated with high powered laser imagers of related art ink-based digital printing systems.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for ink-based digital printing, comprising:

jetting a dampening fluid pattern onto a conformable porous surface of an imaging member configured to swell after absorbing the dampening fluid pattern, the jetting of the dampening fluid pattern onto the conformable porous surface of the imaging member including jetting the dampening fluid pattern of silicone oil onto a silicone surface of the imaging member;

transferring the dampening fluid pattern to a transfer member at a dampening fluid pattern loading nip defined by the transfer member and the imaging member;

applying ink to a surface of the transfer member having the dampening fluid pattern to produce an ink pattern; and transferring the ink pattern to a substrate at an ink pattern loading nip defined by the transfer member and a substrate transport system.

2. The method of claim 1, comprising:

conditioning the ink pattern to increase a viscosity of the ink before transfer of the ink pattern to a substrate.

3. The method of claim 1, comprising:

applying heat to the surface of the imaging member to evaporate dampening fluid contained by the imaging member surface.

4. The method of claim 1, comprising:

removing dampening fluid from the surface of the imaging member after the transferring the dampening fluid pattern, the removing comprising blotting and vacuuming the surface of the imaging member.

5. The method of claim 4, the transferring the dampening fluid pattern step including transferring the dampening fluid pattern to the transfer member at the dampening fluid pattern loading nip under a first pressure at the dampening fluid pattern loading nip, and the removing dampening fluid step including blotting the surface of the imaging member under a second pressure greater than the first pressure.

6. The method of claim 1, comprising:

removing ink remaining on the surface of the transfer member after the transferring the ink pattern.

7. The method of claim 1, the jetting step including jetting the dampening fluid pattern onto a conformable porous foam surface of the imaging member.

8. The method of claim 1, the jetting step including jetting the dampening fluid pattern onto a conformable porous sponge surface of the imaging member.

9. The method of claim 1, the transferring the dampening fluid pattern step including transferring the dampening fluid pattern to the transfer member at the dampening fluid pattern loading nip under a first pressure at the dampening fluid pattern loading nip, and removing residual dampening fluid from the conformable porous surface of the imaging member after the dampening fluid pattern loading nip under a second pressure greater than the first pressure.

10. The method of claim 1, the transferring the dampening fluid pattern step reducing the amount of the dampening fluid that gets transferred onto the transfer member due to splitting at the loading nip.

11. The method of claim 10, wherein the transferring the dampening fluid pattern to a transfer member step and the applying ink to a surface of the transfer member steps occur in sequence absent application of a vacuum or heat source.

12. The method of claim 1, the conformable porous surface fixed to the imaging member and configured to swell and remain fixed after absorbing the dampening fluid pattern.

13. A method for ink-based digital printing, comprising:

jetting a dampening fluid pattern onto a conformable porous surface of an imaging member configured to swell after absorbing the dampening fluid pattern, the jetting of the dampening fluid pattern onto the conformable porous surface of the imaging member including jetting the dampening fluid pattern onto a porous silicone surface of the imaging member;

transferring the dampening fluid pattern to a transfer member at a dampening fluid pattern loading nip defined by the transfer member and the imaging member;

applying ink to a surface of the transfer member having the dampening fluid pattern to produce an ink pattern; and transferring the ink pattern to a substrate at an ink pattern loading nip defined by the transfer member and a substrate transport system.

* * * * *